US009051640B2

(12) United States Patent
Liu

(10) Patent No.: US 9,051,640 B2
(45) Date of Patent: Jun. 9, 2015

(54) METHOD OF MANUFACTURING TRANSPARENT CONDUCTIVE THIN FILM

(75) Inventor: Tongjun Liu, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 442 days.

(21) Appl. No.: 13/464,177

(22) Filed: May 4, 2012

(65) Prior Publication Data

US 2012/0280188 A1 Nov. 8, 2012

(30) Foreign Application Priority Data

May 6, 2011 (CN) ..... 2011 1 0117442

(51) Int. Cl.

| | |
|---|---|
| ***B05D 5/12*** | (2006.01) |
| ***C23C 18/12*** | (2006.01) |
| *B05D 3/02* | (2006.01) |
| *H01B 1/08* | (2006.01) |

(52) U.S. Cl.

CPC ..... *C23C 18/1216* (2013.01); *B05D 3/02* (2013.01); *B05D 5/12* (2013.01); *H01B 1/08* (2013.01); *C23C 18/1233* (2013.01); *C23C 18/1245* (2013.01); *C23C 18/1254* (2013.01); *C23C 18/1279* (2013.01); *C23C 18/1295* (2013.01)

(58) Field of Classification Search

USPC ..... 427/126.3, 240, 380, 383.1

See application file for complete search history.

(56) References Cited

PUBLICATIONS

Tongjun et al., "Preparation and Process Chemistry of SnO2 Films derived from SnC2O4 by the aqueous Sol-Gel Method", Journal of American Ceramic Society, vol. 91, pp. 1939-1944 (2008).*

Biwas et al., "Aquo-organic sol-based F-doped SnO2(Sn:F=90:10) coatings on glass", Materials Science-Poland, vol. 24, No. 2/1, pp. 367-374 (2006).*

Tongjun Liu; "Transparent Conductive Oxide (TCO) Films Prepared by Sol-gel Approach", Chinese Doctoral Dissertations Full-tex Database, Engineering and Science and Technology I, vol. 12, Dec. 15, 2010; 2 pages.

First Chinese Office Action dated May 6, 2014; Appln. No. 201110117442.0.

* cited by examiner

*Primary Examiner* — Brian K Talbot

(74) *Attorney, Agent, or Firm* — Ladas & Parry LLP

(57) ABSTRACT

An embodiment of the disclosed technology discloses a transparent conductive thin film and a method of manufacturing the same. The embodiment of the disclosed technology employs tin (II) oxalate ($Sn_2C_2O_4$) as a raw material, acetic acid and ammonia as complex agents to form a neutral complex system with a pH=6.5~7.5, and trifluoroacetic acid as dopant to form a stable doping of F ions, and has a high doping efficiency.

4 Claims, 2 Drawing Sheets

METHOD OF MANUFACTURING TRANSPARENT CONDUCTIVE THIN FILM

BACKGROUND

Embodiments of the disclosed technology relate to a transparent conductive thin film and method of manufacturing the same.

The pixel electrodes of a thin film transistor-liquid crystal display (TFT-LCD) device currently mainly employs indium tin oxide (ITO, $In_2O_3$:Sn) thin film produced by magnetron sputtering. Since this thin film contains rare element—indium (In), the manufacturing cost is increased. In addition, since target materials and manufacturing equipments used to produce such a thin film are generally expensive, the device cost is also increased.

As an alternative to the ITO thin film, tin dioxide ($SnO_2$) thin film is used, which is a n-type semiconductor material with a band gap of 3.6 eV, has the advantages of high electron mobility (109.56 $cm^2/Vs$), high carrier concentration ($1.23\times 10^{19}$ $cm^{-3}$), high transmittance, chemical stability at high temperature, and low raw material price, and is widely used for transparent conductive layers, gas sensitive devices, solar cells and electrodes of Lithium-ion battery.

Currently, the production of $SnO_2$ thin films mainly adopts magnetron sputtering, low pressure chemical vapor deposition (LPCVD), high temperature spraying, sol-gel and so on. Among the above, LPCVD is most commonly used, and the raw material of such process is tin chloride ($SnCl_4$) and hydrofluoric acid (HF), and there exists a problem that the costs of raw material and equipment are relatively high.

Compared with other several methods, the sol-gel method has the advantages of simplicity, low cost, high efficiency, easy doping, and abliligy to be coated on irregular shape devices and to produce uniform thin films of large area. The raw materials of this process are $SnCl_2.2H_2O$ and $SnCl_4.5H_2O$. During the production of $SnO_2$ thin film, a large amount of chlorine ion ($Cl^-$) can cause non-stoichiometric ratio of doping, thereby it will influence the conductivity of the formed thin film. Meantime, the solution obtained after the raw materials are mixed must be kept at a particular acidity (pH=1~2) so as to prevent the strong hydrolysis reaction of $SnCl_2.2H_2O$ and $SnCl_4.5H_2O$. However, in producing pixel electrode of a TFT-LCD device by using such a method, the acid environment can corrode gate electrodes and data lines formed in the TFT-LCD device, which therefore limits the application of such a method in the production of pixel electrodes of the TFT-LCD device.

SUMMARY

The embodiments of the present disclosed technology provide a transparent conductive thin film and method of manufacturing the same, which may reduce costs of raw material and manufacturing equipment, and such method may be applied to the production of pixel electrodes of TFT-LCD device.

To achieve the above objects, the embodiments of the present disclosed technology adopt the following technical solution:

A method of manufacturing a transparent conductive thin film, comprises: adding Tin (II) oxalate ($Sn_2C_2O_4$) into an aqueous solution of acetic acid and then performing stirring to form a suspend system; adding ammonia ($NH_3.H_2O$) into the suspend system, and performing stirring to form a clear solution, and a pH of the clear solution is equal to 6.5~7.5; adding trifluoroacetic acid into the clear solution, and performing stirring to form a sol system containing fluorine ion; coating the sol system containing fluorine ions on a substrate, and sequentially performing dry process and heat treatment process, to form a $SnO_2$:F thin film on the substrate.

A transparent conductive thin film, which is produced by the above method of manufacturing a transparent conductive thin film.

In the transparent conductive thin film and manufacturing method thereof provided by the embodiments of the present disclosed technology, $Sn_2C_2O_4$ is used as raw material, acetic acid and ammonia are used as complex agent, a neutral complex system with a pH=6.5~7.5 is formed, trifluoroacetic acid is further used as dopant. This dopant forms a stable doping of F ion by complexing with Sn ion, and the doping efficiency is high. Since such manufacturing method adopts cheap $Sn_2C_2O_4$ as raw material, and can form desired transparent conductive thin film on the substrate only by using methods of coating and heat treatment, without additional and complex manufacturing apparatus, the costs of the raw material and equipment to produce the transparent conductive thin film are reduced. Further, the neutral sol system formed by neutral complex system may make such manufacturing method to be applicable to the production of pixel electrodes of TFT-LCD device, without corroding the metal lines of array substrate.

BRIEF DESCRIPTION OF DRAWINGS

To more clearly explain the technical solutions of the embodiments of the present disclosed technology, in the following a description will be made in connection with the accompanying drawings. Obviously, the drawings described below are only related to some embodiments of the present disclosed technology, and those skilled in the art may obtain other figures according to these figures without paying inventive labor.

DETAILED DESCRIPTION

An embodiment of the present disclosed technology provides a method of manufacturing a transparent conductive thin film, comprising: adding $Sn_2C_2O_4$ into an aqueous solution of acetic acid and then performing stirring to form a suspend system; adding ammonia into the suspend system, and then performing stirring to form a clear solution, and the pH of the clear solution is equal to 6.5~7.5; adding trifluoroacetic acid into the clear solution, and then performing stirring to form a sol system containing fluorine ion; and coating the sol system containing fluorine ions on a substrate, and sequentially performing dry process and heat treatment process, to form a $SnO_2$:F thin film on the substrate.

Another embodiment of the present disclosed technology further provides a transparent conductive thin film, which is produced by the above method of manufacturing a transparent conductive thin film.

With the transparent conductive thin film and manufacturing method thereof provided by the embodiments of the present disclosed technology, $Sn_2C_2O_4$ is used as a raw material, acetic acid and ammonia are used as complex agents, a neutral complex system with pH=6.5~7.5 can be formed, trifluoroacetic acid is further used as a dopant. This dopant forms a stable doping of F ion by complexing with Sn ions, and the doping efficiency is high. Since such manufacturing method adopts cheap $Sn_2C_2O_4$ as a raw material, and can form a desired transparent conductive thin film on a substrate only by using methods of coating and heat treatment, without additional and complicated manufacturing equipment, the costs of the raw material and equipment to produce the transparent conductive thin film can be reduced. Further, the neutral sol system formed by the neutral complex system may make such a manufacturing method to be applicable to the production of pixel electrodes of TFT-LCD device, without corroding the metal lines of array substrate.

Figure 1:
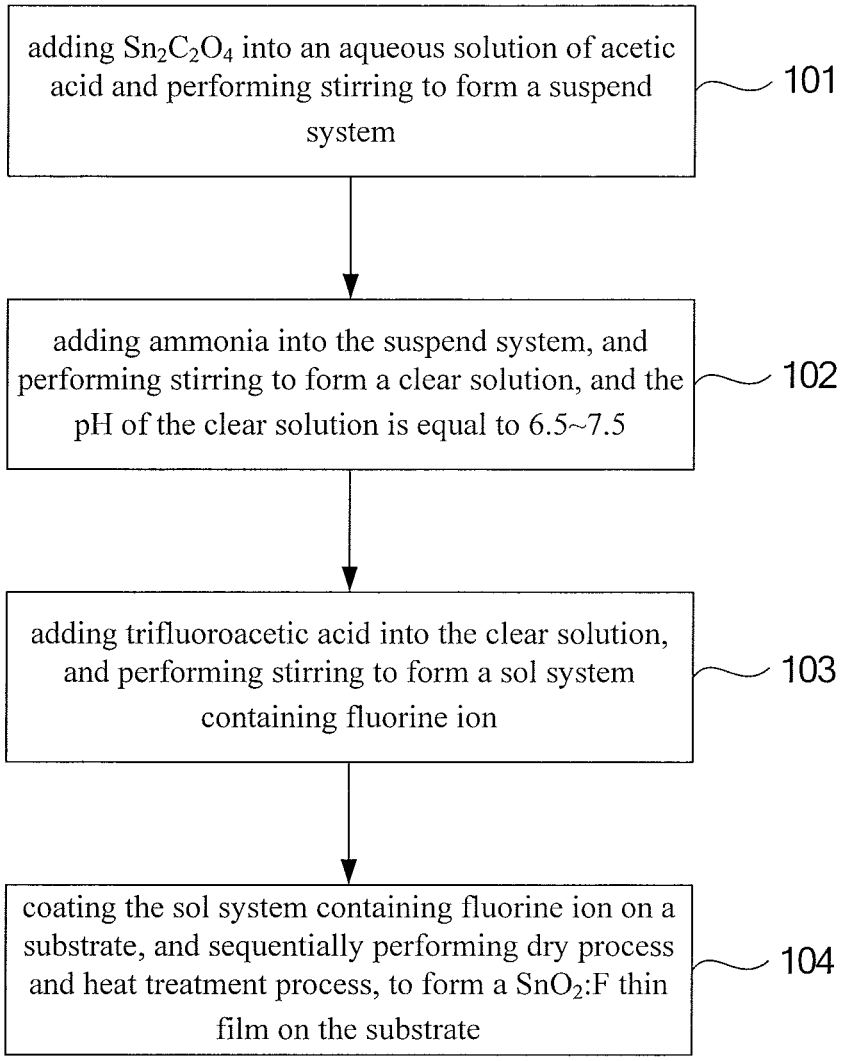
FIG. 1 is a flow chart of a method of manufacturing a transparent conductive thin film according to an embodiment of the present disclosed technology.

The embodiment of the present disclosed technology provides a method of manufacturing a transparent conductive thin film, and as shown in FIG. 1, the method comprises the following steps.

Step 101. Adding $Sn_2C_2O_4$ into an aqueous solution of acetic acid and then performing stirring to form a suspend system.

In examples, it is found through tests (see Table 1) that, in the system using water as the solvent, even a complex agent, such as acetic acid (HAc) or ammonia ($NH_3.H_2O$), of an excessive amount is used, $SnC_2O_4$ can not be completely dissolved and complexed by only a single complex agent aqueous to form a clear and stable solution system.

TABLE 1

| Solution system | pH value | Dissolving phenomenon |
|---|---|---|
| Ac—$H_2O$ | 3~4 | Not dissolved |
| $NH_3$—$H_2O$ | >11 | white colloidal precipitation |

This is because acidity of acetic acid is weaker than that of oxalic acid. The carboxylate ion provided by the acetic acid aqueous solution do not have enough complex ability to destroy the original molecule structure of $SnC_2O_4$ to generate $Sn^{2+}$ ion having four coordination positions. Moreover, the degree of ionization of $SnC_2O_4$ in the aqueous solution is very small, so the amount of $Sn^{2+}$ ions which are generated by ionization and may perform four-coordination complex and the amount of Sn(II) hydroxyl groups which are generated by hydrolysis and having —OH to be complex substituted are very small.

Figure 2:
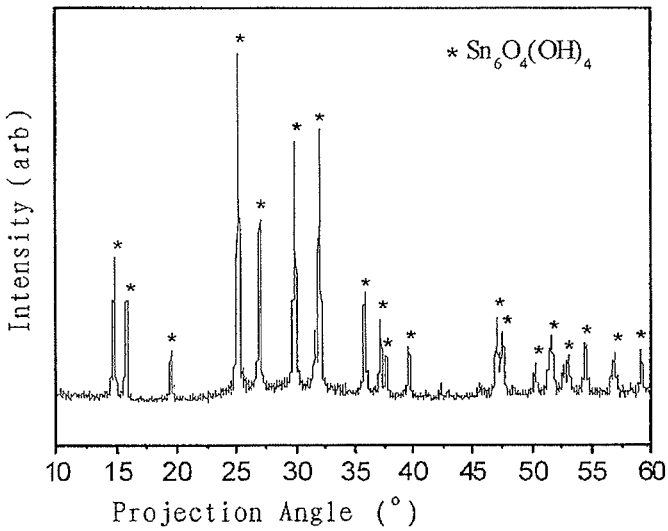
FIG. 2 is a view of measurement result of X-ray Diffraction of the white colloidal precipitation generated by adding $Sn_2C_2O_4$ into $NH_3.H_2O$ according to the embodiment of the present disclosed technology.

The tests also shown that $SnC_2O_4$ in the $NH_3.H_2O$ is in a white colloidal precipitation state, and the X-ray Diffraction (XRD) test result (as shown in FIG. 2, the horizontal coordinate represents projection angle, and the longitudinal coordinate represents intensity) of the white colloidal precipitation shows that it is $Sn_6O_4(OH)_4$, that is condensation structure of $(Sn(OH)_n)^{2-n}$, and $(Sn(OH)_n)^{2-n}$ is a group that can be complex by carboxylate ion. The chemical reaction molecular formula when $SnC_2O_4$ is in the $NH_3$—$H_2O$ is as the following:

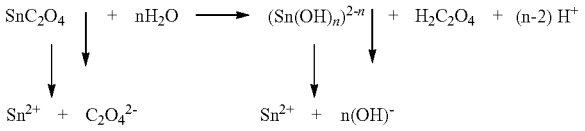

Step 102. Adding ammonia ($NH_3.H_2O$) into the suspend system, and then performing stirring to form a clear solution, and the pH value of the clear solution is equal to 6.5~7.5.

In particular, it is found through tests (see Table 2) that in the mixed aqueous solution of acetic acid and ammonia, the pH value significantly influences the dissolvability of $SnC_2O_4$.

TABLE 2

| Solution system | pH value | Dissolving phenomenon |
|---|---|---|
| Ac—$NH_3$•$H_2O$—$H_2O$ | >7.5 | White colloidal precipitation |
| | 6.5~7.5 | Clear and stable solution |
| | <6.5 | Not dissolved |

After adding the basic solvent $NH_3.H_2O$ into the above suspend system, it can accelerate the generation of $(Sn(OH)_n)^{2-n}$, and the basic environment due to $NH_3.H_2O$ also accelerates the ionization of acetic acid; that is to say, it can accelerate the generation of carboxylate ion, so that the probability of the complex of carboxylate ions with Sn ions can improved. It can be seen from Table 2 that, in order to form a clear and stable solution, the pH value of the suspend system with the added $NH_3.H_2O$ is equal to 6.5~7.5.

The complex process may be described as the following three steps with reference to the following molecular formula.

Step 1: the adding of the basic solvent $NH_3.H_2O$ introduces OH— or accelerates the solvent $H_2O$ to generate OH— by ionization, and the increase of OH— concentration accelerates $SnC_2O_4$ to decompose to form the hydroxyl group of Sn;

Step 2: the adding of the basic solvent $NH_3.H_2O$ accelerates the ionization of carboxyl (—COOH), which provides more carboxylate ions (—COO—), so that the complex ability is increased; and Step 3: the hydroxyls in the hydroxyl groups of Sn are continually substituted by —COO—, and thus a stable Sn sol is eventually formed in which the carboxylate is the complex group.

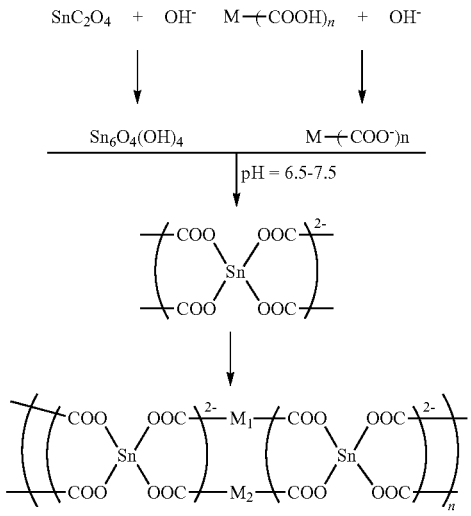

To make the conductivity of the finally formed transparent conductive thin film to be excellent, it is preferable to dope a certain amount of conductive ions in the above clear solution, and the doping of the conductive ion may be achieved by the above step.

Step 103. Adding trifluoroacetic acid into the clear solution, and the performing stirring to form a sol system containing fluorine ion.

In particular, since the content of fluorine (F) ions in trifluoroacetic acid (TFA) which is used as the F ion dopant is relative higher in the same kind organic compound, and therefore it can significantly improve the doping efficiency of F ions in the transparent conductive thin film.

In addition, since the acidity of TFA is a little stronger than that of acetic acid, but weaker than that of oxalic acid and citric acid and so on, thus TFA in the Ac—$NH_3.H_2O$—$H_2O$ can form complex structure (the molecular formula is shown as follows) with Sn ion in the complex system like the acetic acid, so as to improve the stability of F ions in the sol system, and thus improve doping efficiency.

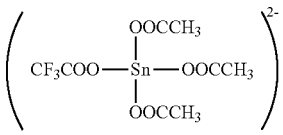

Step 104. Coating the sol system containing fluorine ions on a substrate, and sequentially performing dry process and heat treatment process, to form $SnO_2$:F thin film on the substrate. The method of coating the sol system containing fluorine ions on a substrate may be spin-coating.

The dry process and heat treatment process remove $H_2O$, C and H elements in the sol system by making them volatilize at a high temperature or oxidation reaction, and the remained components form a transparent conductive thin film-$SnO_2$:F thin film on the substrate, that is, a $SnO_2$ thin film doped with F ion. The substrate may be a glass substrate, a plastic substrate, or a silica substrate.

When the treatment temperature of the heat treatment process is 300° C. and the treatment time period of the heat treatment process is 5 min, the effect of forming the film is desirable, and the transparent thin film can have desirable flatness and conductivity.

The method of spin-coating the sol system containing fluorine ions on a substrate may be applicable for the formation of the thin films.

An example of the above heat treatment process may comprise but not limited to: placing the substrate in a sealed heat treatment container; performing heat treatment on the substrate; controlling the partial pressure of HF gas in the heat treatment container, to control the doping efficiency of F ions in the $SnO_2$:F thin film. The HF gas is generated by the volatilization of the organic substance containing fluorine in the sol system coated on the substrate which is heated.

After performing coating, drying and heat treatment processes one time, if the thickness of the formed thin film does not reach the required thickness, the step of coating the sol system containing fluorine ions on the substrate and sequentially performing dry process and heat treatment process may be repeated, so as to make the formed $SnO_2$:F thin film reach a designated thickness.

An embodiment of the present disclosed technology also provides a transparent conductive thin film, and this thin film is produced by any of the above-described methods of manufacturing a transparent conductive thin film.

The following will give four specific examples to explain the method of manufacturing a transparent conductive thin film, and the respective process parameters of the various examples can be found in the following Table 3.

TABLE 3

| Example | $SnC_2O_4$ (kg) | 1.65 M/mL HAc(L) | $NH_3$•$H_2O$ (L) | pH | dopant TFA(L) | heat treatment temperature (° C.) | heat treatment period (min) | coating times |
|---|---|---|---|---|---|---|---|---|
| 1 | 1.25 | 15 | 10 | 6.5 | 5 | 300 | 5 | 5 |
| 2 | 1.25 | 15 | 10 | 6.5 | 5 | 350 | 5 | 5 |
| 3 | 1.25 | 24 | 20 | 6.5 | 5 | 300 | 5 | 5 |
| 4 | 1.25 | 24 | 20 | 6.5 | 5 | 350 | 5 | 5 |

In the method of manufacturing a transparent conductive thin film provided by the embodiment of the present disclosed technology, $Sn_2C_2O_4$ is used as a raw material, acetic acid and ammonia are used as complex agents, a neutral complex system with pH=6.5~7.5 is formed, trifluoroacetic acid is further used as a dopant. This dopant forms a stable doping of F ions by complex with Sn ions, and the doping efficiency is high. Since such manufacturing method adopts cheap $Sn_2C_2O_4$ as a raw material, and can form desired transparent conductive thin film on the substrate only by using methods of coating and heat treatment for example, without additional and complicated manufacturing equipment, the costs of the raw material and equipment to produce the transparent conductive thin film can be reduced. Further, the neutral sol system formed by the neutral complex system may make such manufacturing method to be applicable to the production of pixel electrodes of a TFT-LCD device, without corroding the formed metal lines of array substrate.

In the exemplary manufacturing method of the above transparent conductive thin film, the treatment temperature of the heat treatment process may be but not limited to 280° C.~380° C., for example 300° C.; moreover, the treatment time period of the heat treatment process may be but not limited to 3~15 minutes (min), for example 5 minutes.

In Table 3, 1.65 M/mL HAc indicates the concentration of the acetic acid that is used.

The performance detecting results corresponding to the various examples can be found in the following Table 4.

TABLE 4

| Example | transmittance (%) | surface resistance (Ω/□) |
|---|---|---|
| 1 | 92 | 70 |
| 2 | 92 | 90 |
| 3 | 95 | 75 |
| 4 | 93 | 80 |

In the above table, "transmittance" represents transmittance for visible light, and is obtained through measurement within the visible light wavelength range of 380-900 nm by a UV-VIS spectrometer; the surface resistance is obtained through measurement using standard four-probe method by a SDY-5 four-probe meter.

It can be seen from the data in Table 4 that, the treatment temperature of the heat treatment is preferably 300° C. (examples 1 and 3), and the obtained transparent conductive thin film has higher transmittance and lower surface resistance.

The surface resistance of the transparent conductive thin film obtained by the above four examples is in the range of 70~90Ω/□, and the transmittance is in the range of 92~95%, and both are in accordance with the related application standards and, for example, can be used for forming pixel electrodes or common electrodes in a liquid crystal display.

The embodiments of the present disclosed technology can be applied to the manufacturing of the pixel electrodes of TFT-LCD device.

The above embodiments are only detailed embodiments of the present disclosed technology, but the protection scope of the present disclosed technology is not limited thereto. Those with ordinary skills in the art may easily make various changes or substitutions, which should fall within the protection scope of the present disclosed technology. Thus, the protection scope of the present disclosed technology is defined by the claims.

What is claimed is:

1. A method of manufacturing a transparent conductive thin film, comprising:

adding $Sn_2C_2O_4$ into an aqueous solution of acetic acid and then performing stirring to form a suspend system;

adding ammonia into the suspend system, and then performing stirring to form a clear solution, wherein a pH value of the clear solution is in the range of 6.5 to 7.5;

adding trifluoroacetic acid into the clear solution, and then performing stirring to form a sol system containing fluorine ion; and coating the sol system containing fluorine ions on a substrate, and then sequentially performing a dry process and a heat treatment process to form a $SnO_2$:F thin film on the substrate, wherein the treatment temperature of the heat treatment process is 300° C., and the treatment time period of the heat treatment process is 5 min.

2. The method according to claim 1, wherein the method of coating the sol system containing fluorine ions on a substrate is a spin-coating method.

3. The method according to claim 1, wherein the heat treatment process comprises:

placing the substrate in a sealed heat treatment container;

performing heat treatment on the substrate; and controlling a partial pressure of HF gas in the heat treatment container, to control a doping efficiency of F ions in the $SnO_2$:F thin film, wherein the HF gas is generated by volatilization of the heated organic substance containing fluorine in the sol system coated on the substrate.

4. The method according to claim 1, further comprising:

repeating the step of coating the sol system containing fluorine ions on the substrate and then sequentially performing the dry process and the heat treatment process so as to make the formed $SnO_2$:F thin film reach a designated thickness.

* * * * *